United States Patent [19]

Lauritsen et al.

[11] Patent Number: 4,912,289

[45] Date of Patent: Mar. 27, 1990

[54] QUIETED FAST ACTING SWITCH ASSEMBLY WITH VISCO-ELASTIC POLYMER LAMINATED BETWEEN METAL LAYERS

[75] Inventors: Richard L. Lauritsen, Hoffman Estates; Conrad W. Pastwa, West Chicago, both of Ill.; Daniel A. Wycklendt, Milwaukee, Wis.

[73] Assignee: Eaton Corporation, Cleveland, Ohio

[21] Appl. No.: 287,954

[22] Filed: Dec. 21, 1988

[51] Int. Cl.[4] ..... H01H 9/00; H01H 3/60

[52] U.S. Cl. ..... 200/1 R; 200/237; 200/288

[58] Field of Search ..... 200/1 R, 6 R, 402, 405, 200/237, 238, 239, 262, 267–269, 284, 288, 301; 361/398

[56] References Cited

U.S. PATENT DOCUMENTS 3,244,848 4/1966 Chapin et al. ..... 200/284 X
4,703,139 10/1987 Dunlap ..... 200/288 X

OTHER PUBLICATIONS

Pre Finish Metals, Inc., Product Brochure "PCX-12 Sounds Damping Steel", 2 pages (no date).
Olin Metals Research Laboratories, J. C. Fister et al., "Degradation and Recovery of Damping in Incramute", Jan. 1978, 26 pages.
International Copper Research Association, Inc.; Product Brochure "INCRAMUTE", 4 pages (no date).
International Harvestor Co., Solar Div.; A. N. Hammer et al.; "Development of Composite Incramute I Steel Sandwich Structures for use as Circular Saw Blades", Mar. 1975, 31 pages.
Specialty Composites Corp.; "How to Work and Join Tufcote Noiseless Steel"; 4 pages (no date).
Wyle Laboratories; Rex Sinclair; "Study of Noise and Vibration Control Applications of Incramute High Damping Alloy"; Apr. 1974, 105 pages.

*Primary Examiner*—J. R. Scott
*Attorney, Agent, or Firm*—R. A. Johnston

[57] ABSTRACT

A relatively quiet switch assembly having a plurality of spaced contact sets with snap-acting transfer actuation and interconnected by a common bus plate. The bus plate is formed of a swandwich construction having a thin (0.001 Inch) core layer of visco-elastic polymer and thicker layers of copper bonded to both sides of the core layer for sound attenuation upon contact transfer. Where the bus plate is formed to a right-angle bend of R/t – 1.2 the inner layer is formed of half-hard material and the outer layer of fully annealed material.

6 Claims, 1 Drawing Sheet

QUIETED FAST ACTING SWITCH ASSEMBLY WITH VISCO-ELASTIC POLYMER LAMINATED BETWEEN METAL LAYERS

BACKGROUND OF THE INVENTION

The present invention relates to fast-acting or snap-action switches as they are often referred to of the type employed for low voltage high current applications in which a plurality of contact sets are transferred by a common actuator mechanism. Switches of this type are typically employed for operation of automotive accessories as for example, window lift motor actuation switches and switches employed for controlling power adjusted automotive seats. Automotive switch applications of the aforementioned type require high cycle life; and, therefore snap-acting mechanisms have been employed for contact transfer to avoid contact arcing and burning during switching of the high level direct-current inductive loads at the low voltages encountered with onboard automotive power supplies.

Where it is desirable to provide quieted snap-acting switching for automotive passenger compartment application actuation, and particularly where a plurality of snap-acting switch mechanisms are employed, it has been found that the snap-actuation is a source of objectionable noise. In particular, this noise has been amplified by vibration or "ringing" of the bus means or strip typically employed to interconnect the various contact sets for the individual snap-acting contact pair. This "ringing" has been found to be particularly objectionable where more than one set of contacts is actuated simultaneously by user-movement of a common switch actuator. In particular, the rapid succession of sounds from near-simultaneous actuation has been found particularly objectionable in automotive convenience switch applications.

Thus, it has long been desired to find a way or means of providing for common actuation of a plurality of low-voltage high level direct-current snap-acting switches and to provide for quieting of the contact transfer noise and in particular, the ringing of the bus strip for interconnected plural switches.

SUMMARY OF THE INVENTION

Individual snap-acting contact sets are mounted to a base and adapted for common actuation by user-movement of a common actuating member. The individual snap-acting contact sets are interconnected by a common bus means or strip which is fabricated of material exhibiting sound deadening or attenuating properties. The bus means or strip of the present invention is formed of a sandwich construction employing a core of thin visco-elastic polymer material bonded between relatively thicker layers of copper material. In applications where the bus means is required to be formed at a right angle configuration having a minimum radius, the sandwich of material has the layer for the radially inner portion of the bend formed of half-hard copper and the outer layer formed of fully annealed or dead soft copper. The present invention thus provides a switch bus formed of a unique sound deadening material which may be fabricated in sheet form of a sandwich construction and then formed to the desired configuration.

DETAILED DESCRIPTION

Figure 1:
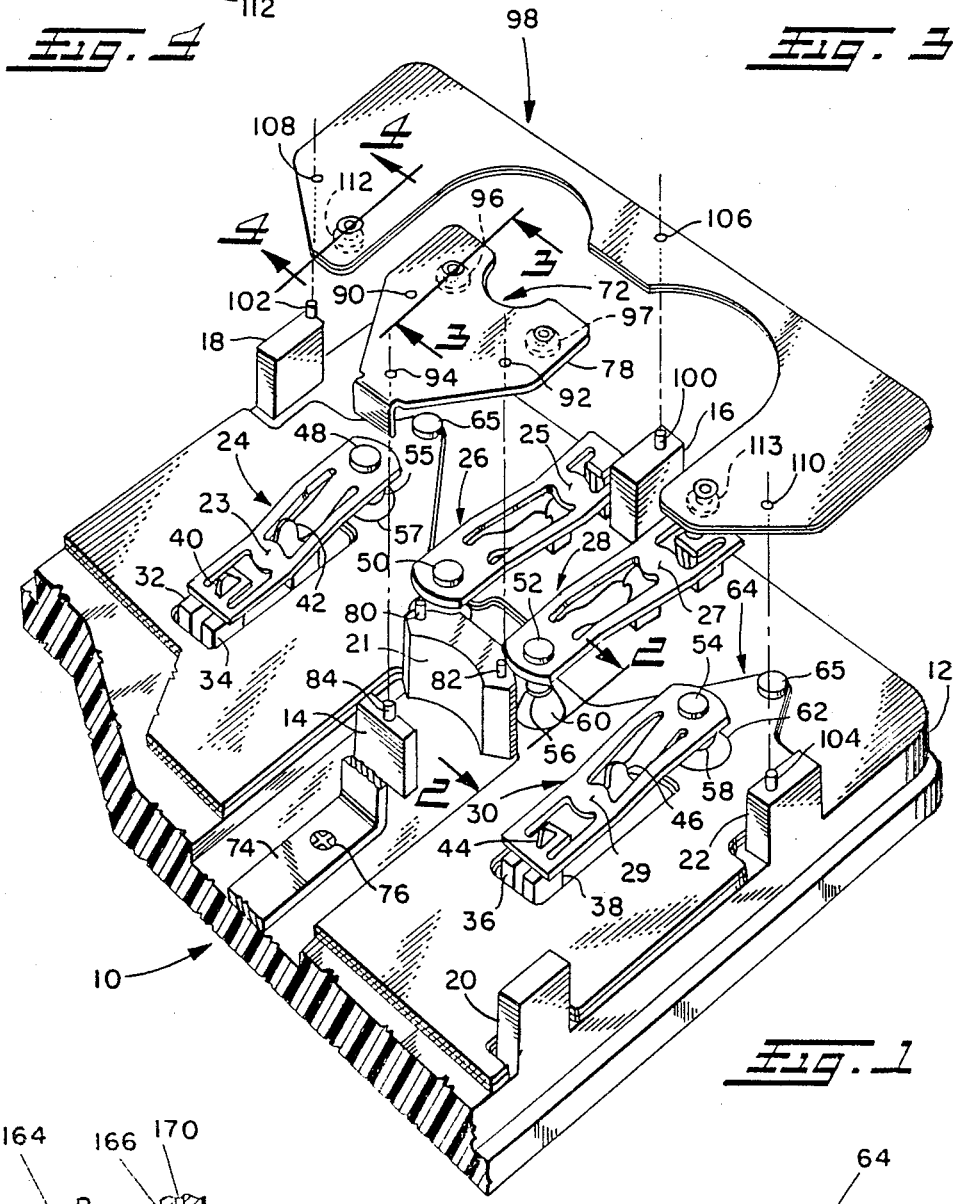
FIG. 1 is a portion of a perspective exploded view of a switch assembly embodying the present invention.

Referring to FIG. 1, the switch assembly is indicated generally at 10, having a base 12, preferably formed of plastic material, with a plurality of spaced bus mounting stanchions 14,16,18,20,21,22 disposed thereabout and extending vertically from the upper surface of base 12 in spaced arrangement.

A plurality of spaced snap acting switch assemblies indicated generally by the reference numerals 24,26,28,30 are disposed in spaced relationship on the base 12. Each of the switches has the blade thereof mounted on a pair of closely spaced switch mounting stanchions, pairs of which are denoted typically by reference numerals 32,34, upon which switch 24 is mounted and 36,38 upon which switch 30 is mounted as shown in FIG. 1. It will be understood that switches 26,28 are similarly mounted. In the presently preferred practice, a copper plate having upstanding tabs thereon is received between the stanchions for mounting each of the switches and the tabs for switch 24 are illustrated typically in FIG. 1 by reference numerals 40,42 and for switch 30 by reference numerals 44,46. Each copper plate such as 40, 44 is typically connected through base 12 to an externally-extending connector terminal (not shown) for electrical connection thereto; and, one such terminal is provided as the common terminal of each switch in a manner well known in the art. Switches 26,28 are mounted in a similar manner.

Each of the switches 24,26,28,30 has a snap-acting blade mechanism with an actuating pad indicated respectively by reference numerals 23,25,27,29 which are adapted for being contacted by separate or a common actuator (not shown). Each of the switches has a double-sided electrical contact mounted thereon for single-pole, double throw action; and, the contacts are denoted respectively by reference numerals 48,50,52 and 54 in FIG. 1. A lower stationary contact is provided for each of the switches and disposed directly underneath the movable contact as shown typically in FIG. 1 for switch 24 by reference numeral 55, for switch 28 by reference numeral 56 and by reference numeral 58 for switch 30.

The lower stationary contacts, such as 55,56,58 are each mounted on a raised or dimpled portion denoted 57,60,62 respectively in FIG. 1 for the switches 24,28,30, which dimpled portions are formed integrally in a main bus means or plate, indicated generally by reference numeral 64 secured to base 12 by rivets 65 and which interconnects the stationary lower contacts for each of the snap-acting switches 24,26,28,30.

Figure 2:
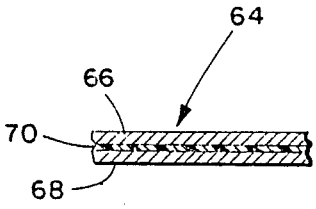
FIG. 2 is a fragmented section view taken along section-indicating lines 2—2 of FIG. 1.

Referring to FIG. 2, a portion of the bus means 64 is shown in cross-section and comprises a sandwich construction having an upper layer 66 and a lower layer 68 each of which is formed of relatively thin copper material. The layers 66,68 have bonded therebetween a thinner layer of core material formed of visco-elastic polymer indicated by reference numeral 70 in FIG. 2. In the presently preferred practice, the layers 66,68 are formed of half-hard copper material with an overall thickness of about 0.5 millimeters with the core layer 70 having a preferred thickness of approximately 0.025–0.05 millimeters. Preferably, one of the layers 66,68 is formed of copper material having a maximum hardness of 55 on the Brinell scale with the other of said layers having a maximum hardness of 71 on the Brinell scale. The layers 66,68 are illustrated as having generally the same thickness; however, it will be understood that differing thickness may be used provided the ratio of the thicker to the thinner does not exceed 1.5.

Referring to FIG. 1, a secondary auxiliary bus means or strip indicated generally at 72 has a generally Z-shaped configuration in side view with a narrow strip portion 74 secured to the base 12 by any convenient means, as for example, rivets 76. The upper wider portion 78 of the auxiliary bus 72 is secured to stanchions 14,21 by a plurality of heat staked lugs 80,82 extending upwardly from stanchion 21 and lug 84 extending upwardly from stanchion 14. The projections 80,82,84 are received through corresponding aperture respectively, 90,92,94 formed in the upper portion 78 of the auxiliary bus 72 and each of the lugs is deformed over the upper surface of the bus portion 78 to retain it on the stanchions 14,21.

Figure 4:
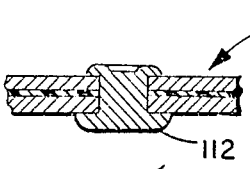
FIG. 4 is a portion of a section view taken along section indicating lines 4—4 of FIG. 1; and, FIG. 5 is a view similar to FIG. 2 of another embodiment of the invention.
Figure 3:
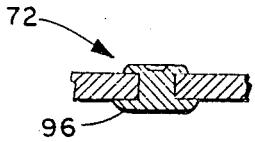
FIG. 3 is a portion of a section view taken along section-indicating lines 3—3 of FIG. 1.

Referring to FIG. 3, the mounting on auxiliary bus 72 of the upper stationary contact 96 for snap switch 26 is shown wherein the contact 96 is riveted through an aperture formed in the upper portion 78 of bus means 72. It will be understood that contact 96 is disposed directly above the movable contact 50 of the snap-acting switch 26. The installation shown in FIG. 4 is typical for the remaining contact 97 provided on an auxiliary bus means 72 which contact is shown in dashed outline in FIG. 3 which is disposed directly above the contact 52 for snap-acting switch 28. Similarly, contact 96, shown in dashed outline in FIG. 1, is disposed directly above contact 50 of switch 26. In the presently preferred practice, auxiliary bus means 72 is formed of a solid strip of hard copper or any suitable bronze stamped into the Z configuration.

Referring to FIG. 1, an upper secondary bus means or plate, indicated generally at 98 is provided and is formed of a sandwich construction similar to the main bus means 64 and as shown in cross-section in FIG. 2. The secondary bus means 98 is secured to the base 12 by projections or vertically extending lugs provided on each of the stanchions 16,18,22 which lugs are indicated respectively by reference numerals 100,102,104 and are received in correspondingly located apertures 106,108,110 provided in the upper bus means 98. Projections 100,102,104 are deformed as for example by heat staking for retaining the bus means 98 onto the stanchions.

Referring to FIG. 4, a typical installation of riveted contact 112 in the sandwiched bus 98 is shown with the rivet in contact with both copper surfaces; and, a similar technique is employed for installation of contacts on main bus 64.

Figure 5:
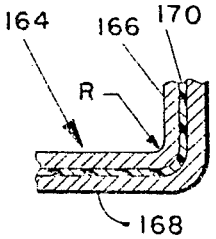

Referring to FIG. 5, a typical stationary upper contact 112 is illustrated as riveted through the upper bus means 98 in a location disposed directly over the movable contacts 48 for switch 24. It will be understood that a corresponding contact is provided on the upper bus means 98 disposed directly over the movable contact 54 of switch 30.

Referring now to FIG. 5, an alternative embodiment of the bus means is illustrated generally at 164 as having a right angle bend formed therein of minimum radius R as may be required for switch applications other than those of the type illustrated in FIG. 1 wherein the main bus mean is a flat plate. In the embodiment of FIG. 5, the ratio of R/t where it is the overall sandwich thickness has a minimum or 1.2. In the presently preferred practice, where the bus means has a right angle bend of minimum radius, the layer of copper material disposed for the radially innermost or shortest radius R is formed of half-hard copper material and the outer layer is formed of fully annealed or dead soft copper material, wherein both the layers 166,168 are however bonded to the central core of visco-elastic polymer 170 when the material is formed in the flat configuration.

The present invention thus provides a unique construction for fast-acting switch assemblies wherein a plurality of snap switches are adapted for action by a common actuator and have the stationary contacts thereof interconnected by a common bus. The bus means of the present invention comprises the sandwich construction of outer layers of copper material bonded over a thin core layer of visco-elastic polymer which construction serves to provide sound deadening and quieting of the impact noise of the rapid contact transfer associated with the fast-acting switch mechanism.

Although the present invention has hereinabove been described with respect to the illustrated embodiments, it will be understood that the invention is capable of modification and variation and is limited only by the following claims.

We claim:

1. A fast-acting electrical switch assembly comprising:

(a) means defining first and second stationary contacts;

(b) movable actuator means including first and second electrically isolated contact means respectively associated with said first and second stationary contacts and upon application of an actuation force thereto said movable means operative for individually making and breaking a circuit between said first stationary and movable contacts and said second stationary and movable contacts;

(c) bus means interconnecting said first and second stationary contacts, said bus means comprising first and second layers of copper material with a layer of visco-elastic polymer material laminated between said first and second layers and bonded thereto, said bus means operative to reduce the level of the sound resulting from said contact movement.

2. The switch assembly defined in claim 1, wherein said first layer is formed of copper material having a maximum hardness of 55 on the Brinell scale and said second layer having a minimum hardness of 71 on the Brinell scale.

3. The switch assembly defined in claim 1, wherein said polymer material has a thickness of 0.025–0.05 mm.

4. The switch assembly defined in claim 1, wherein said first and second copper layers have the ratio of the thicker to the thinnest of the two not exceeding 1.5.

5. The switch assembly defined in claim 1, wherein:

(a) said bus means has a portion thereof formed to a radius of curvature; and, (b) the radially inner layer of copper of said curvature is formed of half-hard copper material with the radially outer layer of copper being formed of fully annealed copper material.

6. The switch assembly defined in claim 1, wherein said bus means has a right-angle bend with the ratio of bend radius to material thickness at least 1.20.

* * * * *